United States Patent [19]

Hapgood

[11] Patent Number: 4,588,026

[45] Date of Patent: May 13, 1986

[54] COILED HEAT EXCHANGER

[75] Inventor: William H. Hapgood, Wayland, Mass.

[73] Assignee: Raytheon Company, Lexington, Mass.

[21] Appl. No.: 313,920

[22] Filed: Oct. 22, 1981

Related U.S. Application Data

[63] Continuation of Ser. No. 47,384, Jun. 11, 1979, abandoned.

[51] Int. Cl.[4] ..... F28F 9/02; F28D 7/10; F25B 27/00

[52] U.S. Cl. ..... 165/158; 165/163; 62/238.6; 62/238.7

[58] Field of Search ..... 165/154, 163, 156, 157, 165/180, 158, 159, 172, 46; 62/98, 238.6, 238.7

[56] References Cited

U.S. PATENT DOCUMENTS

| | | | |
|---|---|---|---|
| 2,316,376 | 4/1943 | Weiss | 165/154 |
| 2,410,912 | 11/1946 | Wenk | 165/154 |
| 3,118,497 | 1/1964 | Olson | 165/157 |
| 3,163,210 | 12/1964 | Horrocks | 165/163 |
| 3,229,762 | 1/1966 | Vollhardt | 165/157 |
| 3,258,067 | 6/1966 | LaFleur | 165/81 |
| 3,315,740 | 4/1967 | Withers | 165/46 |
| 3,419,069 | 12/1968 | Baker | 165/158 |
| 3,435,627 | 4/1969 | Castillo | 165/46 |
| 3,802,491 | 4/1974 | Plank, Jr. et al. | 165/154 |
| 4,144,718 | 3/1979 | Williams | 62/98 |
| 4,177,816 | 12/1979 | Torgeson | 165/172 |
| 4,271,900 | 6/1981 | Reitz | 165/163 |

FOREIGN PATENT DOCUMENTS

| | | | |
|---|---|---|---|
| 2351529 | 4/1975 | Fed. Rep. of Germany | 165/163 |
| 8001468 | 7/1980 | Fed. Rep. of Germany | 165/157 |

*Primary Examiner*—William R. Cline
*Assistant Examiner*—John K. Ford
*Attorney, Agent, or Firm*—John T. Meaney; R. M. Sharkansky

[57] ABSTRACT

A heat exchanger comprising a bundle of flexible tubes extended longitudinally and asymmetrically through a flexible tubing of larger diameter to form a tube-in-tube assembly which is wound helically into a coil of desired size, opposing end portions of the coil being provided with suitable fittings for permitting independent connection of the outer tubing to one fluid source and the bundle of flexible tubes to another fluid source.

9 Claims, 3 Drawing Figures

FIG. 3
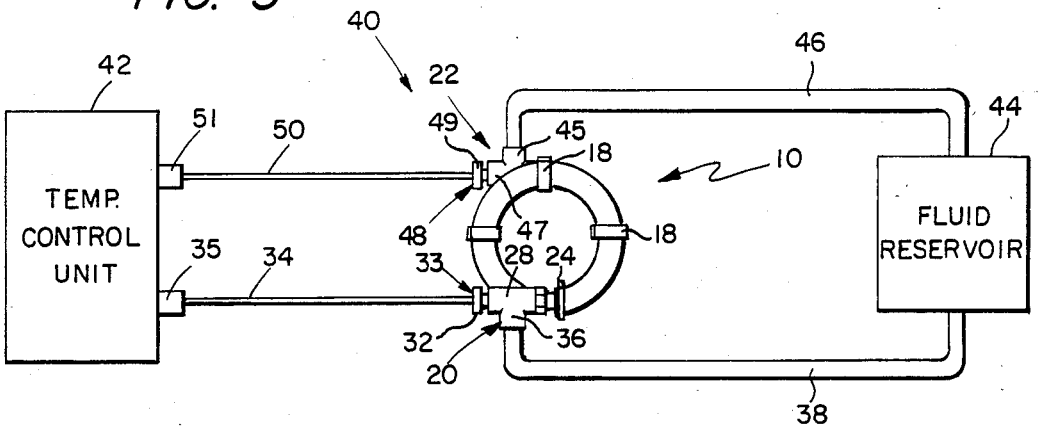
FIG. 1
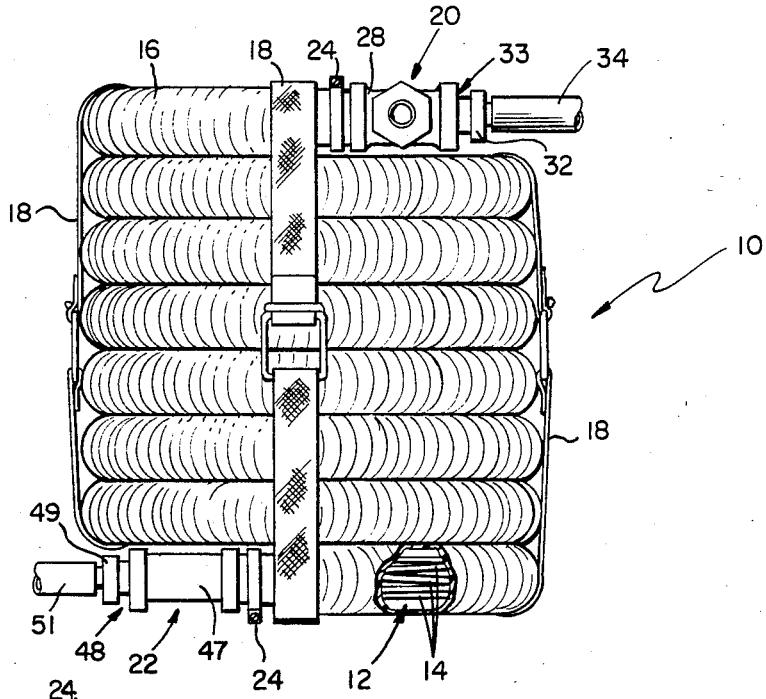
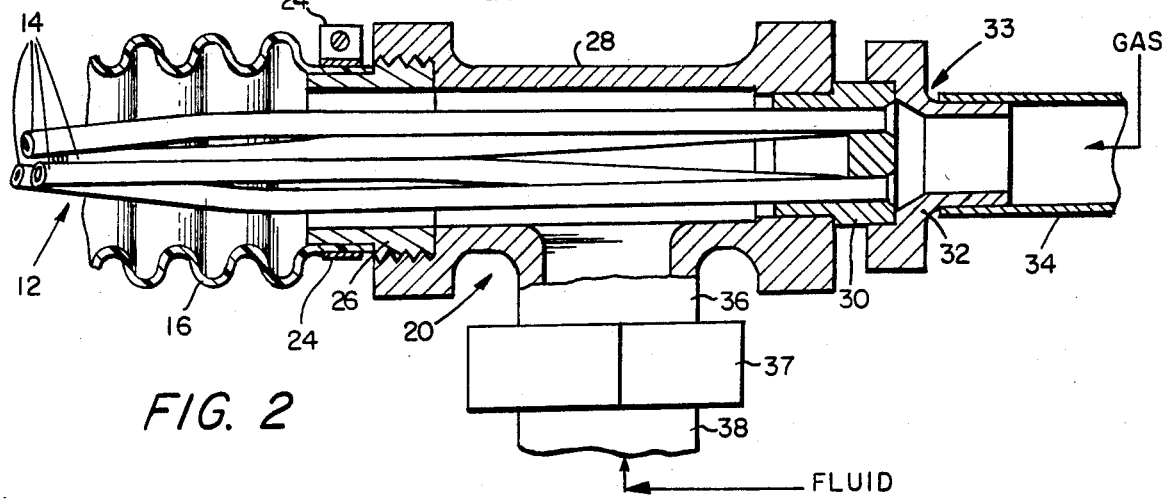
FIG. 2

COILED HEAT EXCHANGER

This is a continuation of application Ser. No. 047,384 filed June 11, 1979, now abandoned.

BACKGROUND OF THE INVENTION

1. Field of the Invention

This invention relates generally to heat exchangers and is concerned more particularly with a flexible tube-in-tube type of heat exchanger wound into a coil of desired size.

2. Discussion of the Prior Art

A tube-in-tube type of heat exchanger may comprise a coaxial pair of annularly spaced inner and outer tubular members through which respective first and second fluids flow. In one mode of operation, heat energy generally is transferred from the first fluid through the wall of the inner tubular member and to the second fluid which carries it away from the heat exchanger. Conversely, in another mode of operation, heat energy is carried to the heat exchanger by the second fluid and transferred through the wall of the inner tubular member to the first fluid flowing therein. Thus, in either mode of operation, heat energy is transferred through the wall of the inner tubular member which, accordingly, is made of good heat conductive material, such as copper, for example.

In a high pressure tube-in-tube type of heat exchanger, the inner tubular member may be replaced by a plurality of smaller diameter tubular members fed in parallel. As compared to a single inner tubular member made of the same material, the combined bundle of smaller diameter tubular members may provide an equivalent cross-sectional area for maintaining a similar rate of fluid flow, and an equivalent surface area for maintaining a similar rate of heat transfer. However, the multiple smaller diameter tubular members provide the additional advantage of operating more efficiently with considerably less wall thickness than the wall thickness required for the single inner tubular member in a high pressure heat exchanger.

Most of the tube-in-tube type heat exchangers of the prior art have outer tubular members made of rigid material. Furthermore, the inner tubular members generally are supported in radially spaced relationship with the wall surfaces of the outer tubular member to ensure that the second fluid in the outer tubular member flows along the entire outer surfaces of the inner tubular members. Consequently, the structural configurations of these prior art heat exchangers generally are fixed in design for fitting in spaces of predetermined size. As a result, if the space available for the heat exchanger is modified in size, the structural configuration of a prior art heat exchanger can be changed only with great difficulty; or a new heat exchanger of more suitable configuration may be required.

Therefore, it is advantageous and desirable to provide a tube-in-tube type heat exchanger having sufficient flexibility for winding it into a coil of desired size for fitting into the space available.

SUMMARY OF THE INVENTION

Accordingly, this invention provides a tube-in-tube type of heat exchanger comprising a bundle of inner flexible tubes made of suitable heat conductive material, such as copper, for example, and longitudinally disposed in random fashion within a larger diameter, outer tubing made of flexible plastic material, such as polyvinylchloride, for example. The resulting tube-in-tube assembly is wound helically into a coil of desired diametric size and length by virtue of the flexibility of the tubular materials and the non-rigid manner in which the inner tubes are disposed longitudinally within the outer tubing. Preferably, the outer tubing is corrugated to provide additional material for expanding longitudinally when being wound into relatively small radius turns.

The heat exchanger is maintained in the desired coil configuration by suitable fastening means, such as an annular array of spaced belts, for example, each of which is passed axially through the coil and longitudinally along the outer wall surface thereof to be secured to itself in the conventional manner. Thus, when the coiled heat exchanger is to be disposed in a space narrower or shorter than the coil, the belts may be unfastened and the heat exchanger re-wound into a coil of more suitable size for fitting into the available space.

Opposing end portions of the inner tubes may extend longitudinally through cross-members of respective tee fittings and be sealed into aligned apertures in respective headers attached to the far end portions of the cross-members. The near end portions of the cross-members may be connected in a fluid-tight manner to respective adjacent end portions of the outer tubing. Each of the headers may be secured in a fluid-tight manner to a respective coupling sleeve having a tapering bore communicating with the apertures of the header to form a manifold device for connecting the adjacent end portions of the inner tubings to a respective port of a first fluid source.

Communicating with the cross-members of the tee fittings are respective orthogonal leg members disposed for connecting the adjacent end portion of the outer tubing to a respective port of a second fluid source. Thus, the tee fittings comprise respective coupling means for permitting adjacent end portions of the inner tubes to be connected through a respective manifold device to a first fluid source and for connecting the adjacent end portion of the outer tubing to a second fluid source. Alternatively, the inner tubes may have opposing end portions connected to manifold devices within the outer tubing so that only the associated coupling sleeves of the devices need be connected through the cross-members of the respective tee fittings to the first fluid source.

In a preferred embodiment, the coupling sleeves of the manifold devices are connected to respective ports of a temperature control unit, such as an air conditioner, for example, whereby a suitable fluid, such as Freon gas, for example, flows under high pressure through the inner tubes of the heat exchanger. Also, the legs of the tee fittings are connected to respective ports of a coolant fluid source, such as a water reservoir, for example, whereby water under a relatively lower pressure flows through the plastic outer tubing of the heat exchanger. As a result, heat energy from the high pressure gas is transferred through the walls of the inner tubes to the water, which carries it away to the reservoir.

Alternatively, the coupling sleeves of the manifold devices may be connected to respective ports of a heat pump; and the legs of the tee fittings may be connected to respective ports of a fluid source. Thus, heated or cooled fluid from the heat pump may flow through the inner tubes of the heat exchanger and heat energy will be transferred through the walls of the inner tubes to affect fluid flowing in the outer tubing and fluid in the connected source accordingly.

BRIEF DESCRIPTION OF THE DRAWING

For a better understanding of this invention, reference is made in the following detailed description to the drawing wherein:

FIG. 1 is an elevational view, partly in section, of a tube-in-tube type of coiled heat exchanger embodying the invention;

FIG. 2 is a fragmentary axial view, partly in section, of an end portion of the coiled heat exchanger shown in FIG. 1; and FIG. 3 is a schematic view of a heat exchanger system using the coiled heat exchanger shown in FIG. 1.

DESCRIPTION OF THE PREFERRED EMBODIMENT

Referring to the drawing wherein like characters of reference designate like parts, there is shown in FIG. 1 a tube-in-tube type of coiled heat exchanger 10 comprising a bundle 12 of inner flexible tubes 14 made of suitable heat conductive material, such as copper, for example. The tubes 14 extend longitudinally and asymmetrically through a larger diameter, outer tubing 16 made of flexible plastic material, such as polyvinylchloride, for example. The flexible materials of tubes 14 and tubing 16 as well as the non-rigid manner in which the tubes 14 are disposed in tubing 16 permit the resulting tube-in-tube assembly to be wound helically into a plurality of turns for forming the coiled heat exchanger 10. Also, the tubing 16 may be corrugated to provide additional material for longitudinal expansion when winding the tube-in-tube assembly into relatively tight turns having small radii.

In this manner, the coiled heat exchanger 10 may be provided with a desired size for fitting into an available space of larger size. The coiled heat exchanger 10 may be retained in the desired size by suitable fastening means, such as an annular array of spaced straps 18, for example, each of which is passed axially through the coiled heat exchanger 10 and longitudinally along the outer wall thereof to be fastened in the conventional manner. Secured in a fluid-tight manner to terminal end portions of the heat exchanger 10 are respective tee fittings 20 and 22 which provide separate coupling means for connecting to the bundle 12 of inner tubes 14 and connecting to the outer tubing 16. For purposes of conciseness, only the tee fitting 20 will be described in detail. However, it is to be understood that the fitting 22 is connected and functions similarly to the fitting 20.

As shown in FIG. 2, an end portion of outer tubing 16 is peripherally secured, as by encircling clamp 24, for example, to an end portion of tubular adaptor 26 which has an opposing end portion journalled in a fluid-tight manner into the adjacent end portion of cross-member 28 of tee fitting 20. Secured in a fluid-tight manner, as by brazing, for example, in the opposing end portion of cross-member 38 is a header 30 having extended through it a plurality of apertures equal in number to the number of inner tubes 14. Inner tubes 14 extend longitudinally through the cross-member 38 and are peripherally secured, as by brazing, for example, in respective apertures of the header 30. Peripherally attached to a protruding end portion of header 30 is a coupling sleeve 32 having a tapering axial bore which communicates with the end portions of tubes 14 secured in the apertures of header 30.

The opposing end portion of sleeve 32 is circumferentially attached, as by brazing, for example, to an encircling end portion of a conduit 34 through which a fluid under high pressure, such as Freon gas, for example, may flow. Thus, the header 30 and the coupling sleeve 32 constitute a manifold device 33 for connecting the bundle 12 of inner tube 14 in parallel to the conduit 34. The axial leg 36 of tee fitting 20 has an end portion communicating with the cross-member 28 and an opposing end portion attached in a fluid-tight manner, as by gland 37, for example, to an end portion of a conduit 38. The conduit 38 may carry a fluid, such as water, for example, which passes through the tee fitting 20 and into the outer tubing 16 to flow along the outer surfaces of inner tubes 14.

As shown in FIG. 3, the coiled heat exchanger 10 may be provided with a suitable size for disposing it within an available space in a heat exchanger system 40. The system 40 may comprise a temperature control unit 42 thermally connected through the heat exchanger 10 to a fluid reservoir 44. The reservoir 44 has a port connected through the conduit 38 to the axial leg 36 of tee fitting 20 at one end of heat exchanger 10, and another port connected through a conduit 46 to the axial leg 45 of tee fitting 22 at the other end of the heat exchanger. Thus, a fluid, such as water, for example, may circulate from the reservoir 44 and through the outer tubing 16 of heat exchanger 10 by passing through conduit 38 and tee fitting 20 to flow along the other surfaces of tubes 14 within the tubing 16. The water then may return through tee fitting 22 and connecting conduit 46 to the reservoir 44.

The cross-member 28 of tee fitting 20 has an end portion attached to the manifold device 33 including coupling sleeve 32 which is connected through conduit 34 to a port 35 of temperature control unit 42. Similarly, a cross-member 47 of tee fitting 22 has an end portion attached to another manifold device 48 including a coupling sleeve 49 which is connected through a conduit 50 to a port 51 of temperature control unit 42. Consequently, a fluid, such as Freon, for example, may flow under high pressure from port 51 through conduit 50 to coupling sleeve 49 of the associated manifold device 48 which functions to direct the Freon simultaneously through all the tubes 14 of bundle 12. At the opposing end portion of heat exchanger 10, the manifold device 33 functions to collect the Freon flowing from the inner tubes 14 and direct it through coupling sleeve 32, from which it flows through conduit 34 and port 35 to return to the temperature control unit 42.

Thus, the temperature control unit 42 may comprise an air conditioner, for example, from which heated Freon gas may flow under high pressure through port 35 and conduit 34 to the inner tubes 14 of heat exchanger 10. Heat energy from the Freon gas is transferred through the walls of tubes 14 to the cooler water flowing along the outer surfaces thereof in tubing 16. As a result, the cooled Freon condenses to a liquid, which flows through conduit 50 and port 51 to return to the air conditioner for recycling. The heated water in tubing 16 flows back to the reservoir 44 to dissipate heat energy therein before being recycled through the heat exchanger 10.

Alternatively, the temperature control unit 42 may comprise a heat pump, for example, which may be operated during cold weather in a manner similar to that described for the air conditioner. Thus, the heat pump sends heated Freon gas through the inner tubes 14 of heat exchanger 10 to transfer heat energy to the water flowing through tubing 16 and heats the water in reservoir 44 to a suitable temperature for use in heating a residence, for example. On the other hand, during hot weather, the heat pump may be operated in the reverse mode to extract heat from the water flowing through tubing 16 of heat exchanger 10 and cood the water in reservoir 44 to a suitable temperature for use in cooling a residence, for example. Accordingly, Freon liquid flows from port 51 and through conduit 50 to the inner tubes 14 where heat energy from the water in tubing 16 is transferred through the walls of tubes 14 to vaporize the Freon therein. As a result, Freon gas flows under high pressure through conduit 34 and port 34 to return to the heat pump for recycling. The cooled water in tubing 16 flows back to the reservoir 44 to extract heat energy from the water therein before being recycled through the heat exchanger 10.

The tubes 14 of bundle 12 may have respective outer diameters and lengths suitable for providing a combined outer surface area equivalent to the total outer surface area required for a single tube of larger diameter and similar length to maintain a desired rate of heat exchange with the fluid flowing in outer tubing 16. Also, the tubes 14 may have respective inner diametric dimensions suitable for providing a combined flow cross-sectional area equivalent to the flow cross-sectional area required for a single tube to maintain a desired rate of fluid flow through the heat exchanger 10.

However, in a system requiring high fluid pressure, a single tube of larger diameter must have a relatively thick wall for withstanding the pressure. On the other hand, the smaller diameter tubes 14 may be provided with considerably thinner walls and safely withstand the high fluid pressure. Consequently, the plurality of smaller diameter tubes 14 in bundle 12 use an optimally minimal of heat conductive metal, such as copper, for example, as compared with a single tube of larger diameter and substantially equal length. Furthermore, in comparison to a single tube having a relatively thick wall, the plurality of smaller diameter tubes 14 having relatively thin walls provide greater flexibility for winding the bundle 12 and outer tubing 16 helically into a coil of desired size.

The diameter of outer plastic tubing 16 is selected to obtain the best combination of water velocity and pressure drop. Since the water flowing from reservoir 44 is under a much lower pressure than the Freon flowing from temperature control unit 42, the flexible plastic material of outer tubing 16 is capable of withstanding the pressure of the water flowing therein. The tee fittings 20 and 22 at respective opposing ends of heat exchanger 10 provide separate access to the water flowing through the tubing 16 whereby the water flow velocity in tubing 16 may be optimized independently of the Freon flow velocity in tubes 14. The inner tubes 14 extending through the cross-members of the respective tee fittings 20 and 22 are disposed longitudinally and asymmetrically within the outer tubing 16, such that respective tubes 14 contactingly engage portions of the tubing inner surface. However, it has been found that this random contacting relationship of respective tubes 14 with inner surface portions of the tubing 16 does not adversely affect the plastic material of tubing 16 or the transfer of heat energy through the walls of tubes 14.

Thus, there has been disclosed herein a tube-in-tube type of coiled heat exchanger having a bundle of inner tubes made of flexible material and extended longitudinally as well as asymmetrically through a larger diameter, outer tubing made of flexible plastic material. The resulting tube-in-tube assembly is wound helically into a coil of desired size for disposal within an available space in a heat exchanger system, which may comprise a temperature control unit thermally connected through the heat exchanger to a fluid reservoir.

Although the bundle 12 is disclosed herein as comprising four inner tubes 14, it may equally well comprise a greater or lesser number of inner tubes, as desired. Also, the respective manifold devices connected to opposing end portions of the inner tubes 14 need not project out of the cross-members of adjacent tee fittings 20 and 22, respectively. The manifold devices, alternatively, may be disposed in respective adjacent end portions of the outer tubing 16, such that only the connecting conduits 34 and 50, respectively, need extend in a fluid-tight manner through the cross-members of the tee fittings.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted as illustrative and not in any limiting sense.

What is claimed is:

1. A heat exchanger comprising:

a corrugated plastic tubing having opposing end portions connected to one another through an intermediate length portion of said tubing;

a bundle of flexible metal tubes extended longitudinally through said intermediate length portion of the tubing and in random lateral relationship with respect to one another and with respect to the inner surface of said intermediate length portion of the tubing, said bundle having opposing end portions disposed adjacent respective ones of said opposing end portions of the plastic tubing;

coupling means secured to respective adjacent end portions of the plastic tubing and the bundle of flexible tubes for connecting separately to the interior of the plastic tubing and to the interiors of the flexible tubes; and said intermediate length portion of said plastic tubing being wound helically into a coil of desired size.

2. A heat exchanger as set forth in claim 1 wherein said flexible tubes within said intermediate length portion of said plastic tubing are disposed freely in an unrestrained manner and are laterally movable relative to one another and to said plastic tubing.

3. A heat exchanger as set forth in claim 1 wherein the coupling means includes manifold means secured to end portions of the flexible tubes for connecting the flexible tubes to single outlet tubes at respective opposing ends of the bundle.

4. A heat exchanger as set forth in claim 1 wherein the coupling means includes respective tee fittings provided with cross-members having end portions secured in a fluid-tight manner to respective adjacent end portions of said corrugated plastic tubing, and communicating with respective axial legs of the tee fittings.

5. A heat exchanger as set forth in claim 4 wherein the coupling means includes respective manifold devices secured in a fluid-tight manner to other end portions of the cross-members and connected in a fluid-tight manner to respective adjacent end portions of the flexible tubes.

6. A heat exchanger system comprising:

a temperature control unit having therein a first fluid and provided with inlet and outlet port means for permitting the first fluid to flow from and return to the temperature control unit;

a fluid reservoir having therein a second fluid and provided with inlet and outlet port means for permitting the second fluid to flow from and return to the reservoir; and a heat exchanger including corrugated plastic tubing, a bundle of flexible metal tubes extended longitudinally through the plastic tubing in random lateral relationship relative to one another and to the tubing, said plastic tubing and the bundle of flexible tubes being wound helically into a coil of desired size and coupling means secured to respective opposing end portions of the plastic tubing and the bundle of flexible tubes and connected to the respective port means of the temperature control unit and the fluid reservoir for directing flow of the first fluid through the flexible tubes of the bundle and directing flow of the second fluid through the plastic tubing.

7. A heat exchanger system as set forth in claim 6 wherein the coupling means includes respective tee fittings provided with cross-members having end portions of the cross-members secured in a fluid-tight manner to adjacent end portions of the plastic tubing, and having communicating axial legs secured in a fluid-tight manner to respective inlet and outlet port means of the fluid reservoir for permitting the second fluid to flow through the plastic tubing.

8. A heat exchanger system as set forth in claim 7 wherein the coupling means includes respective manifold devices attached to the other end portions of the cross-members and connected between adjacent end portions of the flexible metal tubes and respective inlet and outlet port means of the temperature control unit for permitting the first fluid to flow through the flexible tubes of the bundle.

9. A heat exchanger comprising:

a corrugated plastic tubing having opposing end portions and an intermediate length portion for conducting a first fluid therethrough;

a plurality of flexible metal tubes extended within said plastic tubing and having opposing end portions disposed adjacent respective end portions of the plastic tubing for conducting a second fluid through said plurality of flexible metal tubes and transferring heat between said first fluid and said second fluid;

said plastic tubing and said plurality of flexible tubes being wound helically into a coil of desired size; and coupling means for securing end portions of the flexible tubes to end portions of the flexible tubing, the flexible tubes having respective unrestrained mid-portions within said intermediate length portion of said flexible tubing and disposed in random lateral relationship with respect to one another.

* * * * *